US010240417B2

(12) United States Patent
Stangeland

(10) Patent No.: US 10,240,417 B2
(45) Date of Patent: Mar. 26, 2019

(54) WELL TOOL

(71) Applicant: Norse Oiltools AS, Tananger (NO)

(72) Inventor: Jan Stangeland, Sola (NO)

(73) Assignee: Norse Oiltools AS, Tananger (NO)

( * ) Notice: Subject to any disclaimer, the term of this patent is extended or adjusted under 35 U.S.C. 154(b) by 142 days.

(21) Appl. No.: 15/313,957

(22) PCT Filed: Dec. 3, 2015

(86) PCT No.: PCT/EP2015/078476
§ 371 (c)(1),
(2) Date: Nov. 24, 2016

(87) PCT Pub. No.: WO2016/155852
PCT Pub. Date: Oct. 6, 2016

(65) Prior Publication Data

US 2018/0016860 A1 Jan. 18, 2018

(30) Foreign Application Priority Data

Mar. 31, 2015 (NO) ..... 20150391

(51) Int. Cl.
*E21B 27/04* (2006.01)
*E21B 37/00* (2006.01)
*E21B 37/02* (2006.01)

(52) U.S. Cl.
CPC ..... *E21B 27/04* (2013.01); *E21B 37/00* (2013.01); *E21B 37/02* (2013.01)

(58) Field of Classification Search
CPC ..... E21B 27/04; E21B 37/00
See application file for complete search history.

(56) References Cited

U.S. PATENT DOCUMENTS 6,695,058 B1 2/2004 French
2005/0274524 A1* 12/2005 Silguero ..... E21B 31/06 166/311

(Continued)

FOREIGN PATENT DOCUMENTS

WO 2014/133393 9/2014

*Primary Examiner* — Blake E Michener
(74) *Attorney, Agent, or Firm* — Christian D. Abel

(57) ABSTRACT

The present invention provides a tool (1) for removing metal debris from a well bore, comprising a magnet element (2), rotation generating means (5), a debris removal unit (3) and a debris container (6), wherein the magnet element comprises a cylinder-shaped housing (10) having a first end (7) and a second end (8); the debris removal unit (3) comprises a first helix-shaped longitudinal guide element (4) arranged around the cylinder-shaped housing; the rotation generating means (5) are operably connected to the cylinder-shaped housing or the first helix-shaped longitudinal guide element; the debris container (6) comprises a first opening (9) arranged at the second end (8) of the cylinder-shaped housing, wherein the cylinder-shaped housing (10), or the first helix-shaped longitudinal guide element (4), is rotatable around its centerline (C), and configured such that metal debris accumulating on the cylinder-shaped housing during use is guided by the first helix-shaped longitudinal guide element towards the first opening (9) of the debris container when the rotation generating means are operated.

12 Claims, 6 Drawing Sheets

(56) References Cited

U.S. PATENT DOCUMENTS

2008/0023033 A1 1/2008 Potter
2011/0284210 A1* 11/2011 Hern ..... E21B 17/1078
166/99

* cited by examiner

Fig. 3 (P-P)

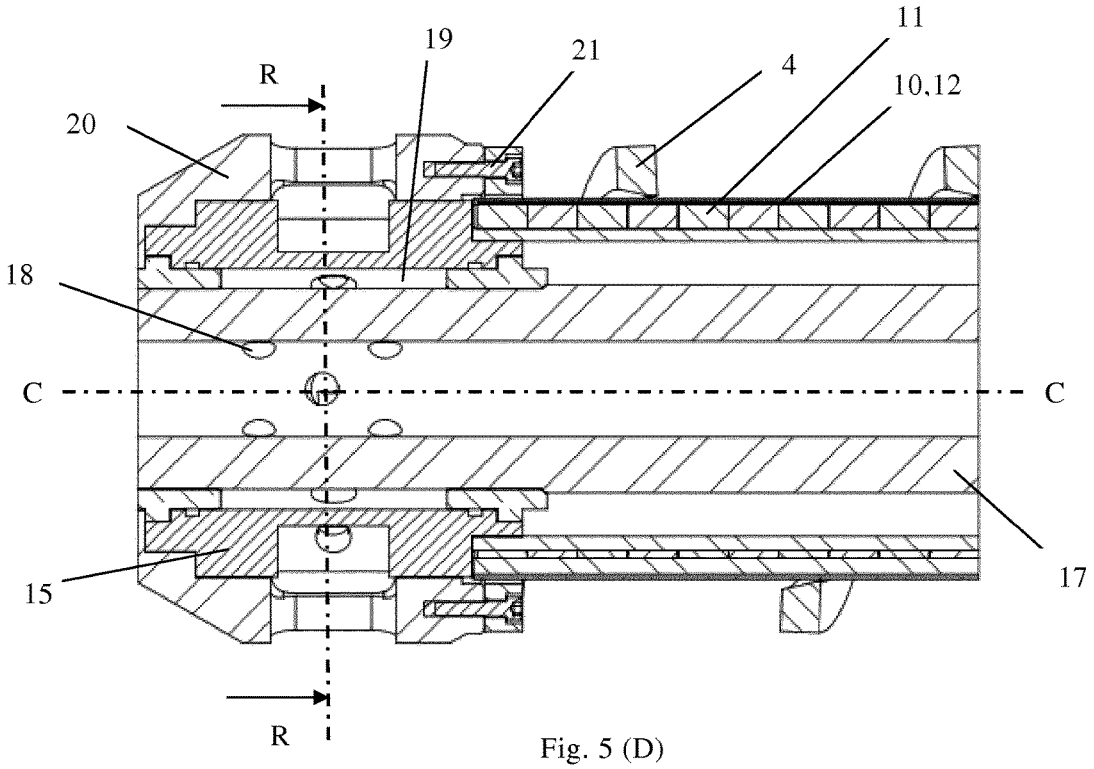
Fig. 5 (D)
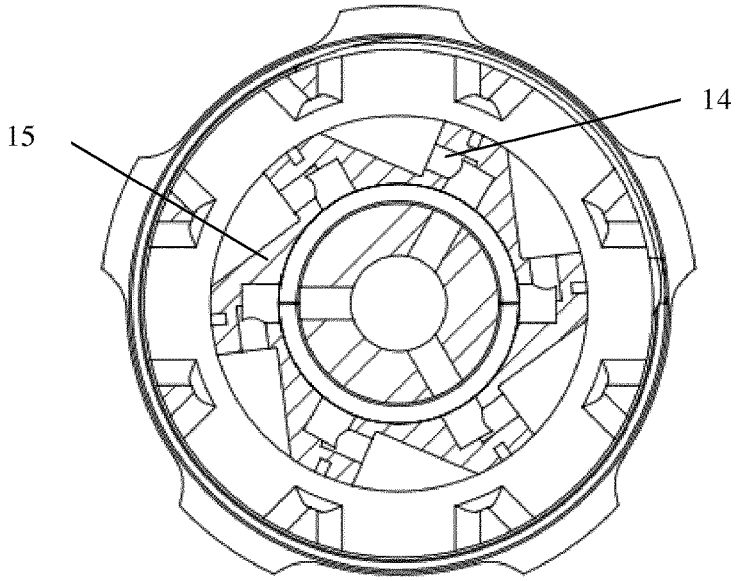
Fig. 6 (R-R)

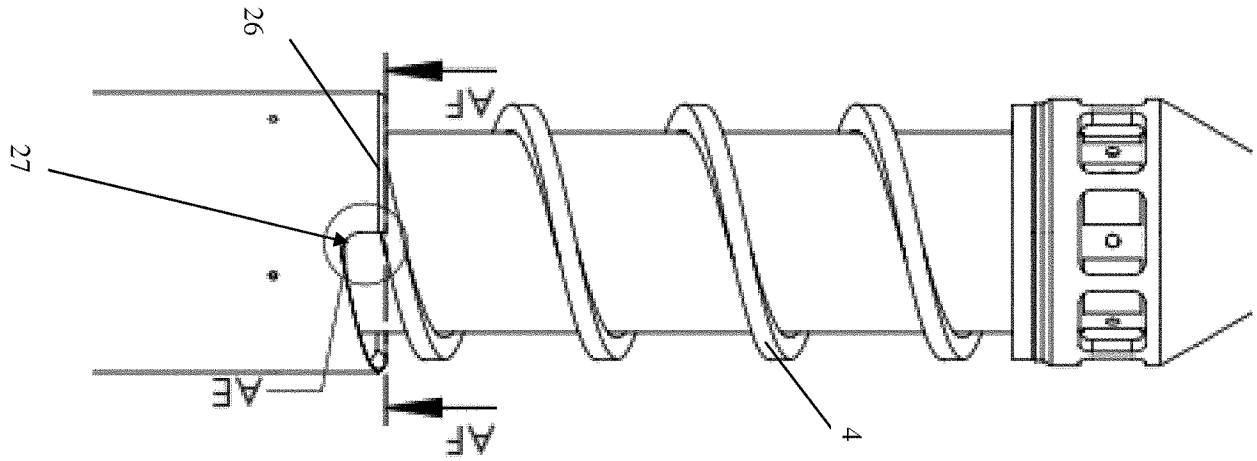
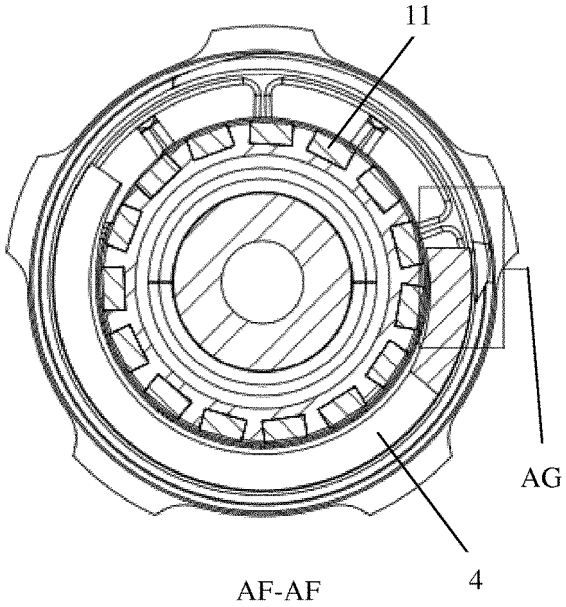
Fig. 7

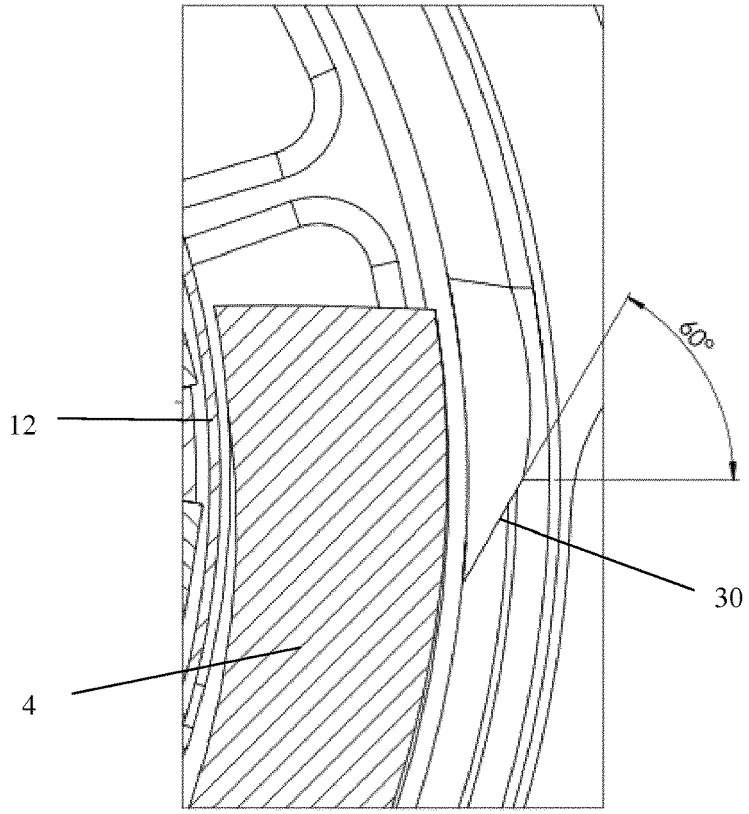
Fig. 8 (detail AG)
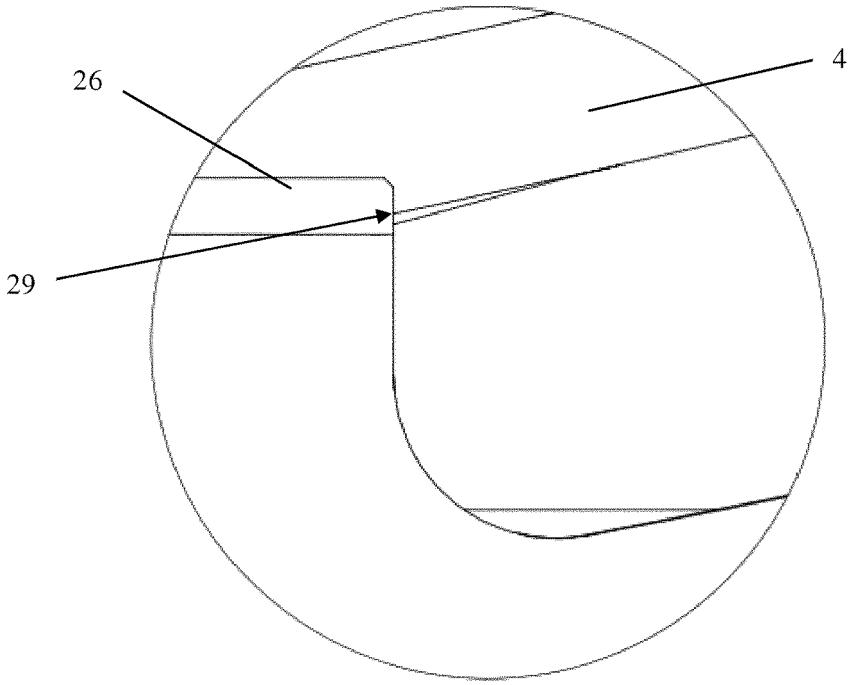
Fig. 9 (detail AE)

WELL TOOL

TECHNICAL FIELD

The present invention concerns the field of metal debris removal, and more particularly a well tool for removal of metal debris from a well bore.

BACKGROUND

In connection with certain well bore operations such as drilling, milling etc. it is required to perform clean-up operations to remove metal debris, i.e. metal chips, shavings remaining in the well. Such debris may otherwise interfere with the proper function of the Blow-Out Preventer (BOP), or other valves present in the well. Metal debris must also be removed before a depleted well is finally plugged to avoid metal debris in the cement plug.

Presently, metal debris is commonly removed by running a downhole magnet into the well. Metal debris is attracted to the magnet. When the magnet has attracted a certain amount of metal debris its magnetic field is weakened and is no longer able to attract further debris. To continue the clean-up operation, the magnet must be returned topside to manually remove the metal debris. After debris removal, the magnet may again be run into the well.

After certain well operations it is necessary to clean the well of metal debris. The requirement may for instance be that less than 0.5 kg of metal debris should remain in the well after clean-up. To fulfil such requirements, a prior art downhole magnet must commonly be run into the well, and returned topside, multiple times. Such operations are time consuming and, consequently, very costly.

The goal of the present invention is to provide a tool for removal of metal debris, which would alleviate or avoid at least some of the disadvantages of the prior art methods and tools.

SUMMARY OF THE INVENTION

The present invention is defined by the appended claims and in the following:

The invention provides a tool, or more specifically a well tool, for removing metal debris from a well bore, comprising a magnet element, rotation generating means, a debris removal unit and a debris container, wherein

- the magnet element comprises a cylinder-shaped housing having a first end and a second end;
- the debris removal unit comprises a first helix-shaped longitudinal guide element arranged around the cylinder-shaped housing;
- the rotation generating means are operably connected to the cylinder-shaped housing or the first helix-shaped longitudinal guide element;
- the debris container comprises a first opening arranged at the second end of the cylinder-shaped housing, wherein

- the cylinder-shaped housing, or the first helix-shaped longitudinal guide element, is rotatable around its centreline, and configured such that metal debris accumulating on the cylinder-shaped housing during use is guided by the first helix-shaped longitudinal guide element towards the first opening of the debris container when the rotation generating means are operated.

In an embodiment of the well tool according to the invention, the rotation generating means comprises at least one of an electric motor, a hydraulic motor and a rotary nozzle assembly. The rotary nozzle assembly features radially inclined nozzles configured such that at least parts of the assembly will rotate when a pressurized fluid is ejected through the nozzles.

In one embodiment of the well tool according to the invention, the debris container is cylinder-shaped, wherein the centreline of the debris container is aligned with the centreline of the cylinder-shaped housing of the magnet element.

In one embodiment of the well tool according to the invention, the rotation generating means are arranged at the first end of the cylinder-shaped housing of the magnet element.

An embodiment of the well tool according to the invention comprises a connecting end distal from the debris container, the connecting end being suitable for connecting the well tool to a wireline, a power cable, an umbilical, a well string, a drill pipe or a coiled tubing.

An embodiment of the well tool according to the invention comprises a tube element aligned around the centreline of the cylinder-shaped housing of the magnet element and extending through the cylinder-shaped housing and the debris container. The tube element may comprise a connecting end distal from the debris container.

In an embodiment of the well tool according to the invention the rotation generating means comprises a rotary nozzle assembly, and the tube element comprises radial through-bores fluidly connected to nozzles of the rotary nozzle assembly.

In an embodiment of the well tool according to the invention the tube element is connectable to a string, pipe or coiled tubing, for instance a drill pipe.

An embodiment of the well tool according to the invention comprises a second helix-shaped longitudinal guide element operably connected to the rotation generating means and arranged within the debris container, the handedness of the second helix-shaped longitudinal guide element is configured such that metal debris being guided by the first helix-shaped longitudinal guide element towards the first opening of the debris container is guided further into the debris container by the second helix-shaped longitudinal guide element when the rotation generating means are operated.

In an embodiment of the well tool according to the invention the rotary nozzle assembly comprises nozzles, which in addition to being radially inclined, are directed at an angle in relation to a plane perpendicular to the centreline of the cylinder-shaped housing and inclined in the direction towards the debris container. The radial inclination of the nozzles provides the required rotational movement of the rotary nozzle assembly, while the combination of the nozzles having an angle in relation to a plane, perpendicular to the centreline of the cylinder-shaped housing, and an inclination in the direction towards the debris container provides a "ricochet" effect wherein the fluid ejected from the nozzles will guide metal debris towards the magnet element. The feature of "having an angle in relation to a plane, perpendicular to the centreline of the cylinder-shaped housing" may also be described as "having an axial inclination".

In an embodiment of the well tool according to the invention the cylinder-shaped housing of the magnet element comprises a section which is tapered towards the second end.

In an embodiment of the well tool according to the invention the first opening of the debris container have an edge featuring a rounded recess at the intersection between the first helix-shaped longitudinal guide element and said edge.

In a further aspect, the invention provides for the use of a tool according to the invention for the removal of metal debris from a fluid source.

The cylinder-shaped housing have a circumferential surface to which metal is attracted by a magnetic field created by magnets embedded below said surface.

The term "rotary nozzle assembly" is intended to mean a rotation generating device which will rotate around an internal axis of the device when a high-pressure fluid is ejected through the nozzles of the assembly.

The term "magnet element" is intended to mean an element comprising parts able to magnetically attract metal debris, such as metal shavings, particles, filings and chips.

BRIEF DESCRIPTION OF THE DRAWINGS

An embodiment of the present invention is described in detail by reference to the attached drawings:

FIG. 5 is an expanded view of the rotary nozzle assembly connected to the magnetic element of the well tool.

FIG. 6 is a perpendicular cross-sectional view of the rotary nozzle assembly in FIG. 5.

FIG. 7 is a side view of a section of the well tool in FIG. 1, and a perpendicular cross-section of the same.

FIG. 8 is a detailed view of parts of the cross-section in FIG. 7.

FIG. 9 is a detailed view of a rounded recess of the well tool in FIG. 7.

DETAILED DESCRIPTION OF EMBODIMENTS OF THE INVENTION

The present invention provides a tool for removal of metal debris from a well, for instance debris lodged in, or in the vicinity of, a BOP. A preferred embodiment of such a tool is described below with reference to the attached drawings.

Figure 1:
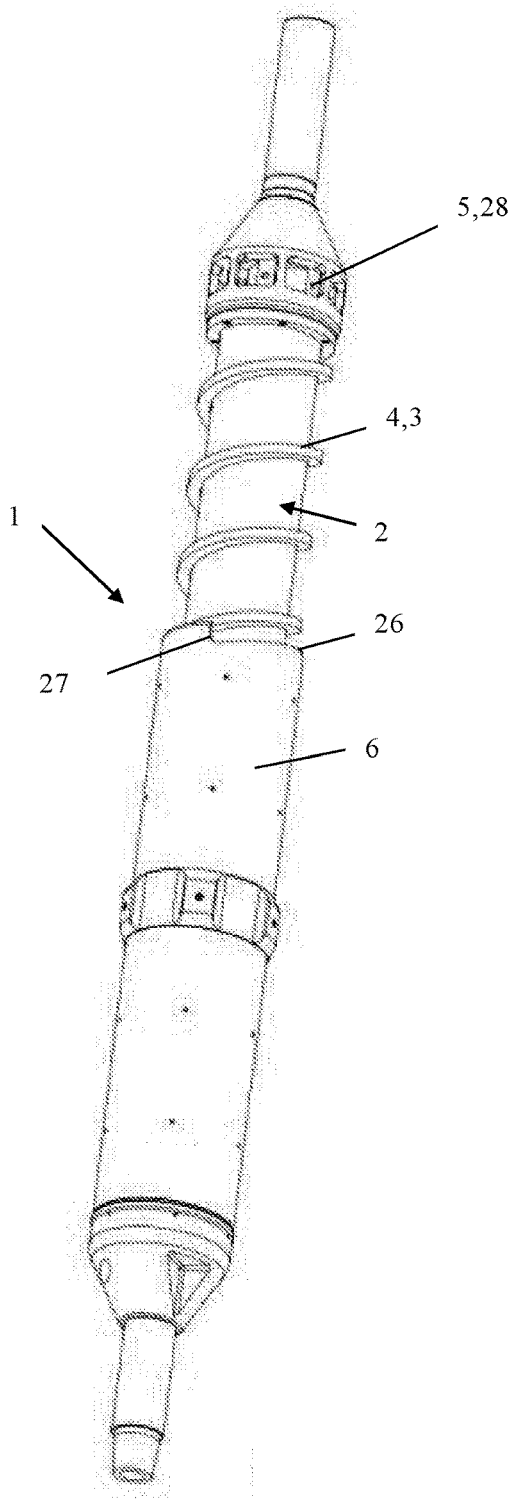
FIG. 1 is a perspective view of a tool according to the invention.
Figure 2:
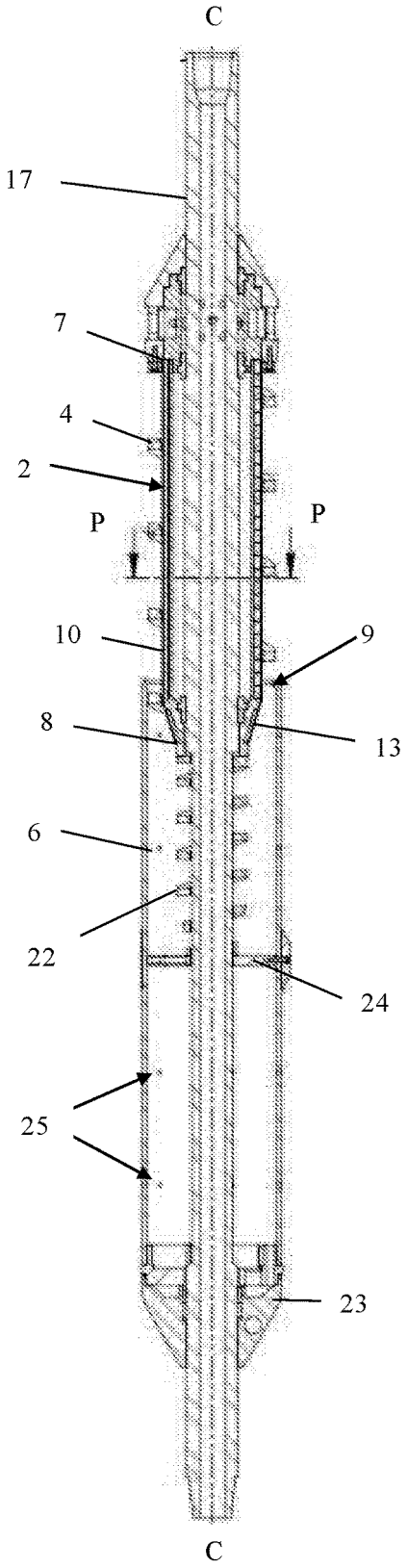
FIG. 2 is a cross-sectional view of the well tool in FIG. 1, the cross-section is along the centreline of the well tool.

A perspective view of a tool 1 according to the present invention is shown in FIG. 1. FIG. 2 is a cross-sectional view of the well tool along the centreline C. The well tool comprises a magnet element 2 for attracting metal debris, a debris removal unit 3 comprising a scrape 4 formed as a helix (i.e. a first helical-shaped longitudinal element), rotation generating means 5 and a debris container 6. The magnet element 2 comprises a cylinder-shaped housing 10 having a first end 7 and a second end 8. The debris container comprises an opening 9 arranged at the second end of the cylinder-shaped housing 10 of the magnet element.

Figure 3:
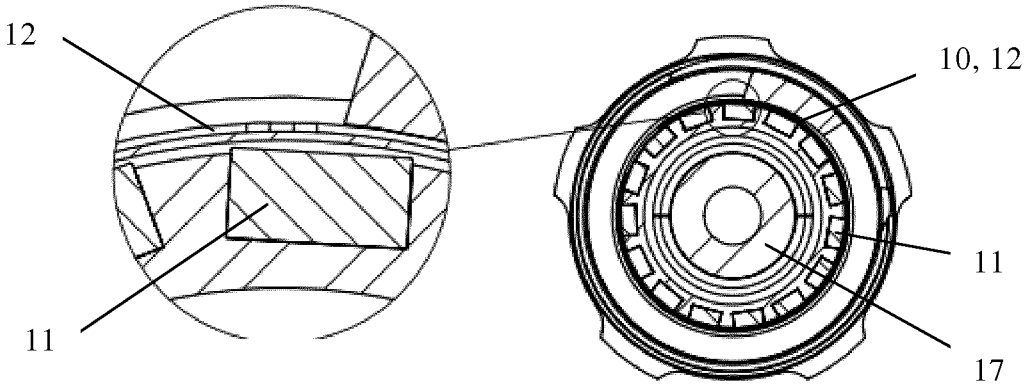
FIG. 3 is a perpendicular cross-sectional view of the magnet element.

In the present embodiment the cylinder-shaped housing 10 comprises multiple magnet rods 11, see FIG. 3, embedded below the surface 12 of the housing. The magnet rods extend in the longitudinal direction of the housing 10 and provide the required magnetic field for attracting metal debris. The magnet rods 11 have a rectangular perpendicular cross-section to provide a large magnetic surface. In other embodiments, the magnetic field may be provided by any type of magnet suitable for being embedded in or below the surface of the cylinder-shaped housing. Preferably, the magnets are incorporated in the cylinder-shaped housing such that the circumferential surface 12 of the cylinder-shaped housing 10 is even. An end section 13 of the cylinder-shaped housing 10 is tapered towards the second end 8 of the housing. The end section 13 has no, or a weakening, magnetic field in the direction of the second end 8 allowing for discharge of metal debris into the debris container 6. In the present embodiment, the magnet rods 11 only extend to the point where the tapering of the end section 13 begins. To ensure that most or all of the metal debris enters the debris container, the whole end section 13 is arranged inside the debris container, i.e. below the first opening 9 of the debris container 6 when the well tool is vertically arranged as shown in FIG. 2.

Figure 4:
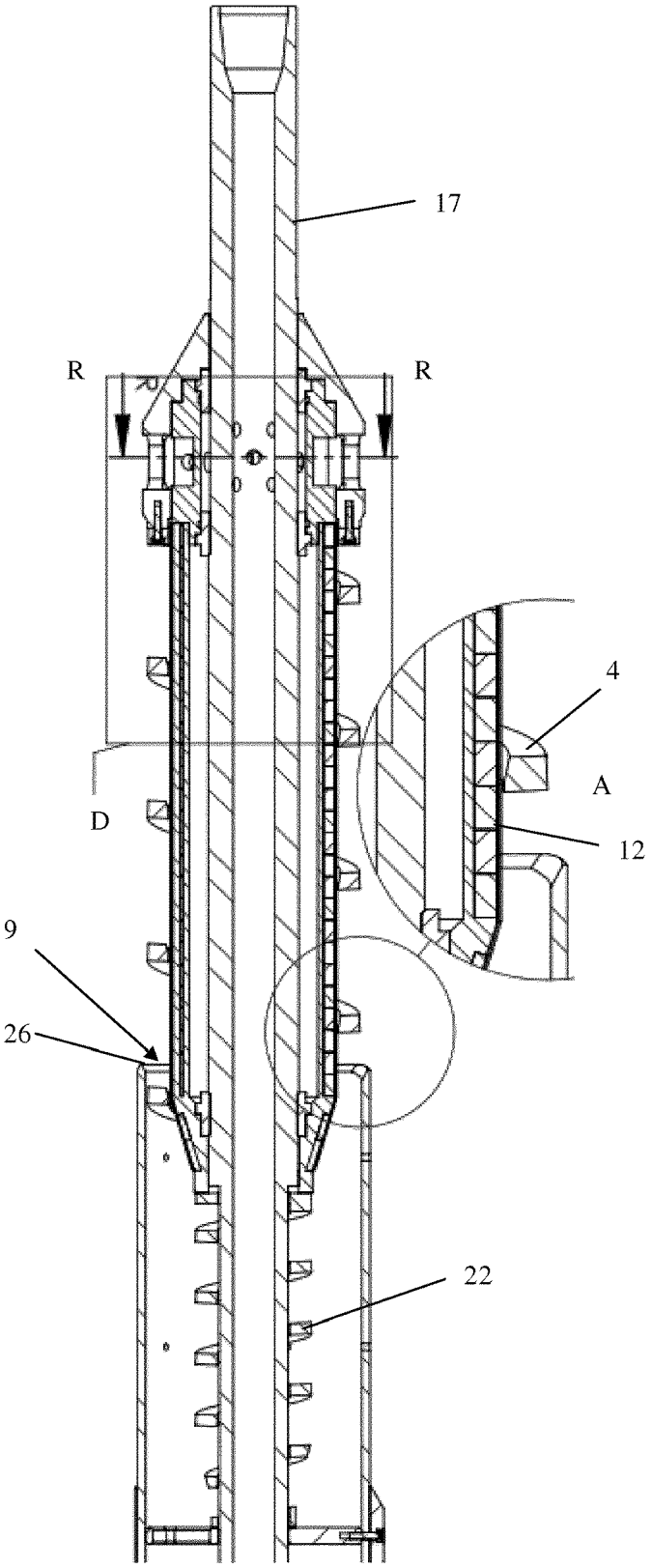
FIG. 4 is an expanded view of the well tool in FIG. 2.

The rotation generating means 5 are in the form of a rotary nozzle assembly 28. The rotary nozzle assembly 28 is operably connected to the magnet element 2, such that said element will rotate around its centreline C (or longitudinal axis) when fluids are ejected through the nozzles 14 having a radial inclination. The rotary nozzle assembly is shown in more detail in FIGS. 5 and 6. In this embodiment, the magnet element 2 is connected to the rotary sleeve 15, such that the magnet element will rotate within the helical scrape when the rotary sleeve revolves around the centreline C. The rotary sleeve have multiple nozzles 14 is fluidly connected to the by through-going holes The scrape 4 (or first helical-shaped longitudinal element) is arranged around and coaxial with the cylinder-shaped housing 10. The inner surface 16 of the scrape (i.e. the surface turned towards the circumferential surface 12 of the cylinder-shaped housing 10) is slightly spaced (0.1-0.5 mm) from the circumferential surface 12. A preferred perpendicular cross-section of the scrape is shown in FIG. 4 (expanded view A). To minimize the risk of metal debris being stuck between the scrape 4 and the circumferential surface 12 of the cylinder-shaped housing, thus preventing the axial rotation of the cylinder-shaped housing 10, the inner surface of the scrape (i.e. the surface of the scrape, or the longitudinal element, which is turned towards the circumferential surface) is inclined away from the circumferential surface 12 in the direction of the first end 7 of the cylinder-shaped housing. An alternative solution to having an inclined inner surface is to arrange a spring-loaded edge at the inner surface of the scrape. The spring will push the edge towards and into contact with the circumferential surface at all times. The scrape 4 is preferably made in non-magnetic stainless steel, i.e. a suitable type of austenitic stainless steel.

The debris container 6 is cylinder-shaped and supported on the tube element 17 by a bottom sleeve assembly 23 and multiple support bars 24. The bottom sleeve assembly 23 of the debris container is fastened to the remaining section of the debris container by a threaded connection. The bottom sleeve may easily be removed when the debris container is to be emptied of metal debris after use. Further, the debris container comprises multiple through-going holes 25. The holes allow mud to flow into the container when the well tool is lowered into a well bore, and to flow out of the container during operation downhole as well as during retrieval of the well tool topside. The edge 26 of the opening 9 in the debris container features a rounded recess 27 at the intersection 29 between the scrape 4 and the edge 26. This recess minimizes the possibility for metal debris to be wedged between the scrape and the edge of the debris container. A more detailed view of the rounded recess is shown in FIGS. 7-9. The rounded recess 27 features an edge surface 30 having a radial inclination to further help in guiding the metal debris into the debris container 6.

In the present embodiment, the well tool 1 comprises a tube element 17 (or pipe) which is coaxially arranged with the cylinder-shaped housing 10, the scrape 4 and the debris container 6. The tube element 17 has radial through-bores 18 fluidly connected to the nozzles 14 via a distribution chamber 19 formed between the tube element 17 and the rotary sleeve 15. The rotary sleeve is connected to the magnet element 2 or cylinder-shaped housing 10 and arranged within a holding sleeve 20 fixed to the tube element 17. By use of any suitable type of bearings (not shown) arranged between the rotary sleeve 15 and the holding sleeve 20 and the tube element 17, the rotary sleeve is free to rotate around the tube element while the holding sleeve is stationary. The rotary nozzle assembly may advantageously also comprise means for controlling the speed of rotation. Such means may for instance entail the use of gears or lubricating fluids of suitable viscosity, and are well known to the skilled person (see for instance EP 1068021 B1). The scrape 4 is connected to the holding sleeve 20 by bolts 21. Thus, the cylinder-shaped housing 10 will rotate relative to the scrape 4 when the rotary sleeve is in motion. In use, the relative rotary motion between the scrape 4 and the cylinder-shaped housing 10 will cause the metal debris, attracted to and accumulated on the magnetic element, to be pushed towards and into the debris container 6. In this way, the strength of the magnetic field of the magnetic element will not be weakened over time due to accumulated metal debris, and it is therefore not required to bring the well tool topside for intermediate discharge/removal of metal debris until the operation is finished.

By use of the rotary nozzle assembly, pressurized fluid in the tube element 17 may be used for providing the rotational movement to the cylinder-shaped housing 10 (or magnet element 2). The pressurized fluid is advantageously drill fluid or mud. The tube element 2 may for instance be connected inline to a drill pipe or to other equipment connected by cross-over to a downhole assembly featuring further downhole tool elements, or form part of a downhole assembly featuring further downhole tools or elements. A downhole assembly may for instance feature two or more tools according to the invention arranged in series by connecting the tube elements together. An advantage of using a rotary nozzle assembly 5 is that in addition to providing the required rotary motion of the cylinder-shaped housing 10, the fluid jet exiting the nozzles 14 may provide for cleaning the inside of the well bore, helping to dislodge debris. In addition to the radial inclination required to obtain the rotary motion of the rotary nozzle assembly, the nozzles may advantageously be directed away from the radial plane (i.e. the plane perpendicular to the centreline of the cylinder-shaped housing) inclined in the direction towards the debris container 6. In this way, at least some of the debris loosened by the nozzle spray is guided towards the cylinder-shaped housing 10 due to the "ricochet effect" of the fluid exiting the nozzles. The latter will also create a whirlpool effect further helping to dislodge metal debris wedged into for instance the ram blocks of a BOP.

In the present embodiment the rotation generating means 5 features a rotary nozzle assembly for providing the required rotary motion of the magnetic element. However, other means for providing rotation is contemplated. Such rotation generating means include for instance an electric or hydraulic motor. Power to the electric motor may be provided by use of a power cable (or umbilical) or a battery pack, while the hydraulic motor may be driven by hydraulic fluid provided through an umbilical.

A compacter unit is arranged within the debris container 6 to guide or push collected metal debris further into the container, i.e. in a direction away from the first opening 9 of the debris container. The compacter unit is made up of a second helical-shaped longitudinal element 22 (or screw) arranged around the tube element 17 and connected to the magnet element at the second end 8 of the cylinder-shaped housing 10. The second helical-shaped longitudinal element 22 will therefore rotate around the tube element in the same direction as the cylinder-shaped housing 10. In the present embodiment, the second helical-shaped longitudinal element 22 has the opposite handedness of the first helical-shaped longitudinal element (scrape 4), i.e. if the first helical-shaped longitudinal element is right-handed, then the second helical-shaped longitudinal element is left-handed.

In the embodiment of FIGS. 1-9, the cylinder-shaped housing 10 is rotated, while the surrounding scrape 4 (or the first helical-shaped longitudinal guide element) is fixed, thus obtaining a relative radial movement between them. In other embodiments the relative radial movement may advantageously be obtained by an opposite solution, i.e. rotation of the scrape while the cylinder-shaped housing is fixed. In such instances the handedness of the first and second helical-shaped longitudinal guide elements are the same.

The invention claimed is:

1. A well tool for removing metal debris from a well bore, comprising a magnet element, a rotation generation device, a debris removal unit and a debris container, wherein the magnet element comprises a cylinder-shaped housing having a first end and a second end;

the debris removal unit comprises a first helix-shaped longitudinal guide element arranged around the cylinder-shaped housing;

the rotation generating device is operably connected to the cylinder-shaped housing or the first helix-shaped longitudinal guide element;

the debris container comprises a first opening arranged at the second end of the cylinder-shaped housing, wherein the cylinder-shaped housing, or the first helix-shaped longitudinal guide element, is rotatable around its centreline, and configured such that metal debris accumulating on the cylinder-shaped housing during use is guided by the first helix-shaped longitudinal guide element towards the first opening of the debris container when the rotation generating device is operated.

2. A well tool according to claim 1, wherein the rotation generating device comprises a rotary nozzle assembly.

3. A well tool according to claim 2, wherein the rotary nozzle assembly comprises nozzles directed at an angle in relation to a plane perpendicular to the centreline of the cylinder-shaped housing and inclined in the direction towards the debris container.

4. A well tool according to claim 1 comprising a connecting end distal from the debris container, the connecting end being suitable for connecting the well tool to a wireline, a power cable, an umbilical, a well string, a drill pipe or a coiled tubing.

5. A well tool according to claim 1 comprising a tube element aligned around the centreline of the cylinder-shaped housing and extending through the cylinder-shaped housing and the debris container.

6. A well tool according to claim 5, wherein the rotation generating device comprises a rotary nozzle assembly, and the tube element comprises radial through-bores fluidly connected to nozzles of the rotary nozzle assembly.

7. A well tool according to claim 5 or 6, wherein the tube element is connectable to a string, pipe or coiled tubing.

8. A well tool according to claim 1 comprising a second helix-shaped longitudinal guide element operably connected to the rotation generating device and arranged within the debris container, the handedness of the second helix-shaped longitudinal guide element is configured such that metal debris being guided by the first helix-shaped longitudinal guide element towards the first opening of the debris container is guided further into the debris container by the second helix-shaped longitudinal guide element when the rotation generating device is operated.

9. A well tool according to claim 1, wherein the cylinder-shaped housing comprises an end section which is tapered towards the second end.

10. A well tool according to claim 1, wherein the first opening of the debris container have an edge featuring a rounded recess at the intersection between the first helix-shaped longitudinal guide element and said edge.

11. A well tool according to claim 1, wherein the debris container is cylinder-shaped, and wherein the centreline of the debris container is aligned with the centreline of the cylinder-shaped housing of the magnet element.

12. A well tool according to claim 1, wherein the rotation generating device is arranged at the first end of the cylinder-shaped housing of the magnet element.

* * * * *